US011814258B2

(12) United States Patent
Yonemoto

(10) Patent No.: US 11,814,258 B2
(45) Date of Patent: Nov. 14, 2023

(54) SHEET BINDING DEVICE, IMAGE FORMING APPARATUS

(71) Applicant: KYOCERA Document Solutions Inc., Osaka (JP)

(72) Inventor: Satoru Yonemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/972,444

(22) Filed: Oct. 24, 2022

(65) Prior Publication Data

US 2023/0127609 A1 Apr. 27, 2023

(30) Foreign Application Priority Data

Oct. 27, 2021 (JP) ..... 2021-175217

(51) Int. Cl.
*B65H 37/04* (2006.01)
*B42C 1/12* (2006.01)

(52) U.S. Cl.
CPC ..... *B65H 37/04* (2013.01); *B42C 1/12* (2013.01); *B65H 2801/27* (2013.01)

(58) Field of Classification Search
CPC ..... G03G 2215/00827; G03G 2215/00848; G03G 2215/00864; B65H 37/04; B65H 2408/122; B65H 2408/1222
USPC ..... 270/58.08
See application file for complete search history.

(56) References Cited

U.S. PATENT DOCUMENTS 6,164,511 A * 12/2000 Chung ..... B42C 1/12 227/111
6,264,189 B1 * 7/2001 Kawata ..... B65H 31/3027 414/789.9
6,474,633 B1 * 11/2002 Hirai ..... B25C 5/1658 227/119
8,613,382 B2 * 12/2013 Jung ..... B27F 7/21 227/156
10,059,025 B2 * 8/2018 Baek ..... B31F 5/001
10,077,165 B2 * 9/2018 Ahn ..... B42B 4/00
10,632,644 B2 * 4/2020 Lee ..... B42B 4/00
11,279,587 B2 * 3/2022 Noso ..... G03G 21/1647
11,511,960 B2 * 11/2022 Choi ..... B65H 37/04
2018/0111285 A1 * 4/2018 Baek ..... B65H 37/04
(Continued)

FOREIGN PATENT DOCUMENTS

JP 2012148862 A 8/2012

*Primary Examiner* — Leslie A Nicholson, III
(74) *Attorney, Agent, or Firm* — Alleman Hall Creasman & Tuttle LLP

(57) ABSTRACT

A binding unit includes first and second movable bodies. The second movable body includes first and second shaft portions. A stapler is secured to the second movable body, and the second movable body is swingably supported with the stapler by the first movable body. A first groove includes a branch part between a middle area and one end area. A second groove branches off from the branch part and is parallel to the first groove. When in a first position, a movable guide portion guides the first shaft portion from the branch part to the second groove. When the first shaft portion moves to the second groove through the branch part, the movable guide portion swings from the first position to a second position. When the second shaft portion reaches the branch part, the movable guide portion in the second position guides the second shaft portion along the first groove.

2 Claims, 7 Drawing Sheets

(56) References Cited

U.S. PATENT DOCUMENTS

2019/0241394 A1* 8/2019 Baek ..... B42C 1/12
2021/0261378 A1* 8/2021 Noso ..... B65H 37/04

* cited by examiner

SHEET BINDING DEVICE, IMAGE FORMING APPARATUS

INCORPORATION BY REFERENCE

This application is based upon and claims the benefit of priority from the corresponding Japanese Patent Application No. 2021-175217 filed on Oct. 27, 2021, the entire contents of which are incorporated herein by reference.

BACKGROUND

The present disclosure relates to a sheet binding device capable of performing a binding process in different orientations and to an image forming apparatus including a sheet binding device.

An image forming apparatus may include a printing device and a finishing device. The printing device forms images on sheets. The finishing device performs various types of finishing processes on the sheets on which images are formed by the printing device.

For example, the finishing device includes a sheet binding device. The sheet binding device performs a binding process on stacks of the sheets on which images are formed by the printing device.

In addition, the sheet binding device may include a binding unit including a stapler. The binding unit can move in the width direction of the stacks of the sheets. The sheet binding device including the binding unit can perform the binding process on a middle area, along the width direction, of the stacks of the sheets or on corner parts of the stacks of the sheets.

In addition, the sheet binding device may have a function of performing the binding process in orientations different for the middle area and the corner parts of the stacks of the sheets.

For example, the sheet binding device is known to include a mechanism for changing the orientation of the binding unit by performing a return operation of moving the binding unit to an end of its movable range and then returning the binding unit to a target position.

The binding unit that changes its orientation in conjunction with the return operation does not require a driving source dedicated to rotating the binding unit. This simplifies the mechanism for driving the binding unit.

SUMMARY

A sheet binding device according to an aspect of the present disclosure includes a sheet tray, a base portion, a binding unit, and a guide portion. The sheet tray is a portion on which sheets are stacked. The base portion extends in a width direction along a specific side of the sheets. The binding unit is capable of reciprocating on the base portion in the width direction and is capable of performing an edge binding process for binding a part of the specific side of the sheets or a corner binding process for binding a corner part of the sheets. The guide portion is formed in the base portion and guides the movement of the binding unit. The binding unit includes a stapler, a first movable body, and a second movable body. The stapler binds the sheets. The first movable body is movable on the base portion in the width direction. The stapler is secured to the second movable body, and the second movable body is swingably supported with the stapler on an upper surface of the first movable body. The second movable body includes a first shaft portion and a second shaft portion each passing through the first movable body. The second shaft portion is disposed to be spaced apart from the first shaft portion upstream in a specific direction extending from a middle area to one end area of the base portion in the width direction. The guide portion includes a first groove, a second groove, and a movable guide portion. The first groove extends in the base portion from the middle area to the one end area in the width direction, includes a branch part between the middle area and the one end area, and guides the first shaft portion and the second shaft portion. The second groove branches off from the branch part, is parallel to the first groove, and guides the first shaft portion. The movable guide portion is disposed at the branch part and is swingable between a first position and a second position. The first shaft portion and the second shaft portion engage with the first groove or the second groove. When the first movable body moves from the middle area to the one end area, the movable guide portion is disposed in the first position to guide the first shaft portion from the branch part to the second groove. When the first shaft portion moves to the second groove through the branch part, the movable guide portion swings from the first position to the second position by being brought into contact with the first shaft portion. When the second shaft portion reaches the branch part after the first shaft portion moves to the second groove, the movable guide portion in the second position guides the second shaft portion along the first groove.

An image forming apparatus according to another aspect of the present disclosure includes a printing device and the sheet binding device. The printing device forms images on sheets. The sheet binding device performs the edge binding process or the corner binding process on a stack of the sheets on which the images are formed by the printing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

Figure 1:
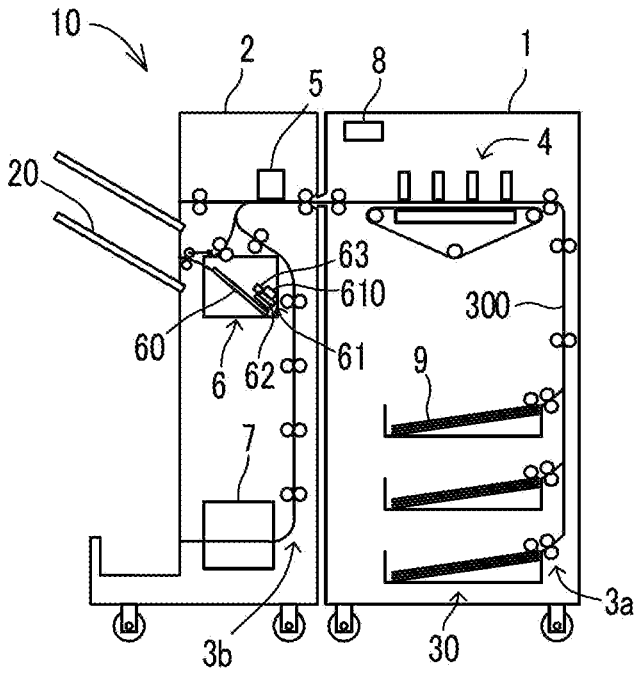
FIG. 1 is a configuration diagram of an image forming apparatus including a sheet binding device according to an embodiment.

A sheet binding device 6 according to the embodiment constitutes a part of an image forming apparatus 10 (see FIG. 1).

The image forming apparatus 10 includes a body portion 1 and a finishing device 2. The image forming apparatus 10 further includes a control device 8. The body portion 1 includes a sheet storing portion 30, a primary sheet conveying device 3*a*, and a printing device 4.

The primary sheet conveying device 3*a* feeds sheets 9 stored in the sheet storing portion 30 one by one to a conveyance path 300. Furthermore, the primary sheet conveying device 3*a* conveys the sheets 9 along the conveyance path 300 inside the body portion 1.

The printing device 4 forms images on the sheets 9 conveyed by the primary sheet conveying device 3*a*. In the example shown in FIG. 1, the printing device 4 forms images on the sheets 9 by an inkjet printing method. The printing device 4 may form images on the sheets 9 by other methods such as an electrophotographic method.

The finishing device 2 can execute various types of sheet processing on the sheets 9 on which images are formed by the printing device 4. In the example shown in FIG. 1, the finishing device 2 includes a secondary sheet conveying device 3*b*, a punching device 5, the sheet binding device 6, and a sheet folding device 7.

The secondary sheet conveying device 3*b* conveys the sheets 9, conveyed from the body portion 1 to the finishing device 2 by the primary sheet conveying device 3*a*, inside the finishing device 2.

The punching device 5 punches holes in the sheets 9 on which images are formed. The sheet binding device 6 binds stacks of the sheets 9 on which images are formed. The sheet folding device 7 folds the sheets 9 on which images are formed.

The punching, binding, and folding processes described above performed on the sheets 9 are examples of the sheet processing. For example, the binding process is a stapling process for binding the stacks of the sheets 9 with metal staples.

The binding process may include processes performed without staples. For example, the binding process may be a process of making cuts in the stacks of the sheets 9 to create raised parts and then folding the parts. Moreover, the binding process may be a process for binding parts of the stacks of the sheets 9 with pressure.

The control device 8 includes a CPU (Central Processing Unit; not shown). The control device 8 further includes a RAM (Random Access Memory), which is a peripheral of the CPU, a secondary storage device, and a signal interface.

The control device 8 executes various types of control by causing the CPU to execute computer programs stored in the secondary storage device. The control device 8 controls the primary sheet conveying device 3*a*, the printing device 4, the secondary sheet conveying device 3*b*, the punching device 5, the sheet binding device 6, and the sheet folding device 7.

The secondary sheet conveying device 3*b* can convey a plurality of sheets 9 to an inclined tray 60 included in the sheet binding device 6. The sheet binding device 6 performs the binding process on lower end parts of the stacks of the sheets 9 on the inclined tray 60. Furthermore, the sheet binding device 6 discharges the stacks of the sheets 9 that have been subjected to the binding process to discharge trays 20.

The sheet binding device 6 includes a binding unit 61 and a transfer device 63. The binding unit 61 includes a stapler 610. The stapler 610 is a device that performs the binding process on the stacks of the sheets 9.

The transfer device 63 moves the binding unit 61 in a main direction D1 set in advance. The sheets 9 are stacked on the inclined tray 60 with their specific side parallel to the main direction D1. The inclined tray 60 is an example of a sheet tray. The main direction D1 is the width direction along the specific side of the sheets 9.

The sheet binding device 6 can move the binding unit 61. The binding unit 61 can perform an edge binding process and a corner binding process. The edge binding process is a process for binding edge parts, parallel to the main direction D1, of the stacks of the sheets 9. In other words, the edge binding process is to a process for binding parts of the specific side, parallel to the main direction D1, of the sheets 9. The binding unit 61 performs the edge binding process to bind a middle area, along the width direction, of the stacks of the sheets 9. The corner binding process is a process for binding corner parts of the sheets 9 at positions away in a specific direction from the positions where the edge binding process is performed.

Furthermore, the sheet binding device 6 has a function of performing the binding process in orientations different for the middle area and the corner parts of the stacks of the sheets 9.

For example, a known device that can perform the binding process may perform a return operation of moving the binding unit 61 to an end of the movable range and then returning the binding unit 61 to a target position. The known device includes a mechanism for changing the orientation of the stapler 610 by performing the return operation.

The stapler 610 that changes its orientation in conjunction with the return operation does not require a driving source dedicated to rotating the stapler 610. This simplifies the mechanism for driving the stapler 610.

However, the known device that performs the return operation every time the orientation of the binding unit 61 needs to be changed requires a longer time to prepare for the binding process.

In contrast, the sheet binding device 6 has a simplified configuration for changing the orientation of the stapler 610 in a short time. The following describes the configuration.

In FIGS. 2 to 14, the main direction D1 is a direction in which the binding unit 61 can move. The transfer device 63 moves the binding unit 61 in a first direction D11 set in advance or in a second direction D12 opposite the first direction D11. Both the first direction D11 and the second direction D12 extend in the main direction D1.

In FIGS. 2 to 14, a crossing direction D2 is orthogonal to the main direction D1. The inclined tray 60 is parallel to both the main direction D1 and the crossing direction D2.

[Configuration of Sheet Binding Device 6]

Figure 2:
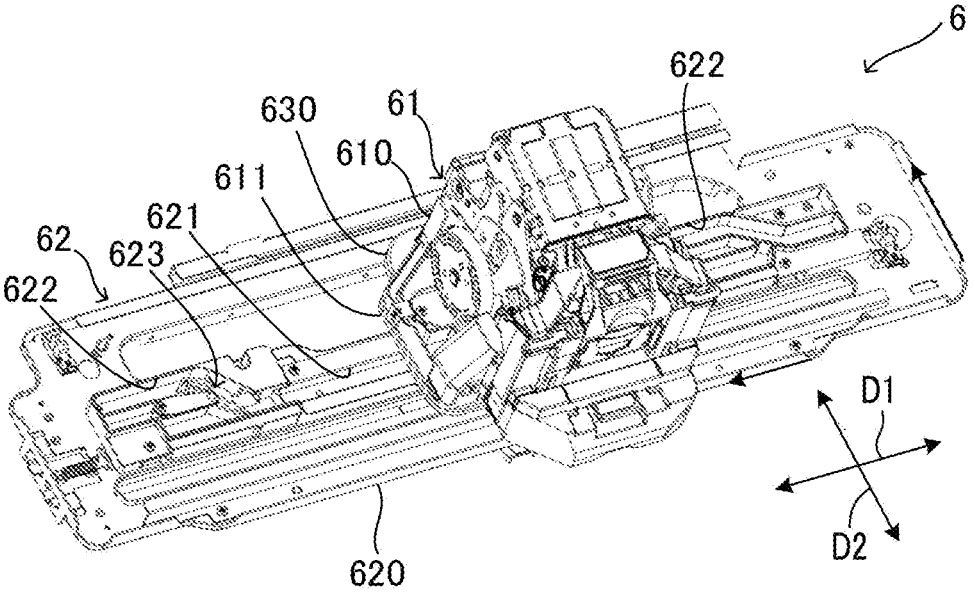
FIG. 2 is a perspective view of the sheet binding device according to the embodiment.

The sheet binding device 6 includes the binding unit 61 and a shaft guide mechanism 62 (see FIG. 2). The binding unit 61 can move in the first direction D11 or in the second direction D12. The shaft guide mechanism 62 is an example of a guide portion that guides the movement of the binding unit 61.

The binding unit 61 includes the stapler 610 and a unit base member 611 (see FIGS. 2 to 5).

The unit base member 611 is integral to the stapler 610. That is, the stapler 610 is secured to the unit base member 611. The unit base member 611 includes two shaft portions 612 disposed parallel to each other (see FIGS. 5 and 6). For example, the two shaft portions 612 protrude from the unit base member 611 in a direction intersecting the main direction D1 and the crossing direction D2.

The transfer device 63 includes a unit support member 630 (see FIGS. 2 to 6). The transfer device 63 moves the unit support member 630 in the first direction D11 or in the second direction D12.

The unit base member 611 is rotatably connected to the unit support member 630. In other words, the unit base member 611 is swingably supported by the unit support member 630. The unit base member 611 swings together with the stapler 610. The unit base member 611 is disposed on the upper surface of the unit support member 630.

Figure 6:
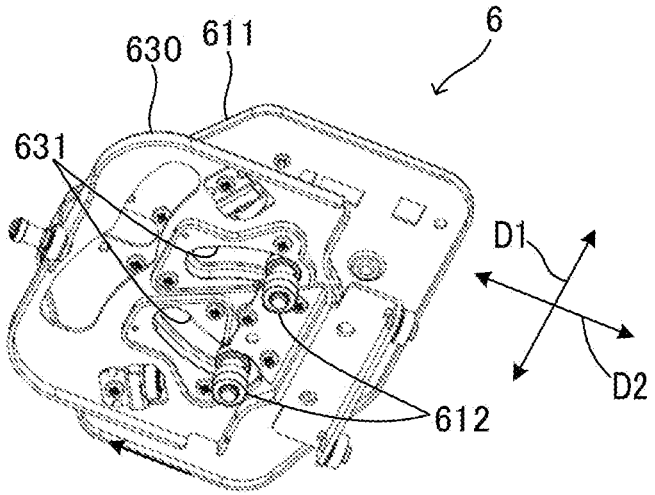
FIG. 6 is a perspective view of the unit base member and a unit support member in the sheet binding device according to the embodiment.

The unit support member 630 has two guide holes 631 through which the two shaft portions 612 pass (see FIG. 6). The two guide holes 631 each have an arc shape and guides the respective shaft portions 612 along arc-shaped travel paths.

The shaft guide mechanism 62 guides the movement of the two shaft portions 612 when the binding unit 61 moves in the first direction D11 or in the second direction D12. The first direction D11 and the second direction D12 are the traveling direction of the binding unit 61.

The shaft guide mechanism 62 includes a guide base member 620, movable guide members 623, and springs 625. The guide base member 620 faces the inclined tray 60. The guide base member 620 extends in the main direction D1. The guide base member 620 has a first groove 621 and second grooves 622. The springs 625 is an example of an elastic member.

The guide base member 620 is an example of a base portion. The unit support member 630 is an example of a first movable body that can move on the guide base member 620 in the main direction D1. The unit base member 611 can move together with the unit support member 630. The unit base member 611 is an example of a second movable body. The binding unit 61 can reciprocate on the guide base member 620 in the main direction D1.

The first groove 621 extends in the main direction D1. The first groove 621 extends in the guide base member 620 from a middle area to end areas. In the initial state, the two shaft portions 612 are aligned in the main direction D1 and fitted in the first groove 621. The two shaft portions 612 engage with the first groove 621 while being fitted in the first groove 621.

The first groove 621 is divided into a first area A1, second areas A2, and border areas A3 set in advance (see FIGS. 7 to 11). The first area A1 includes a middle part in the movable range of the binding unit 61. The second areas A2 include end parts in the movable range of the binding unit 61. The border areas A3 lie between the first area A1 and the second areas A2.

Figure 7:
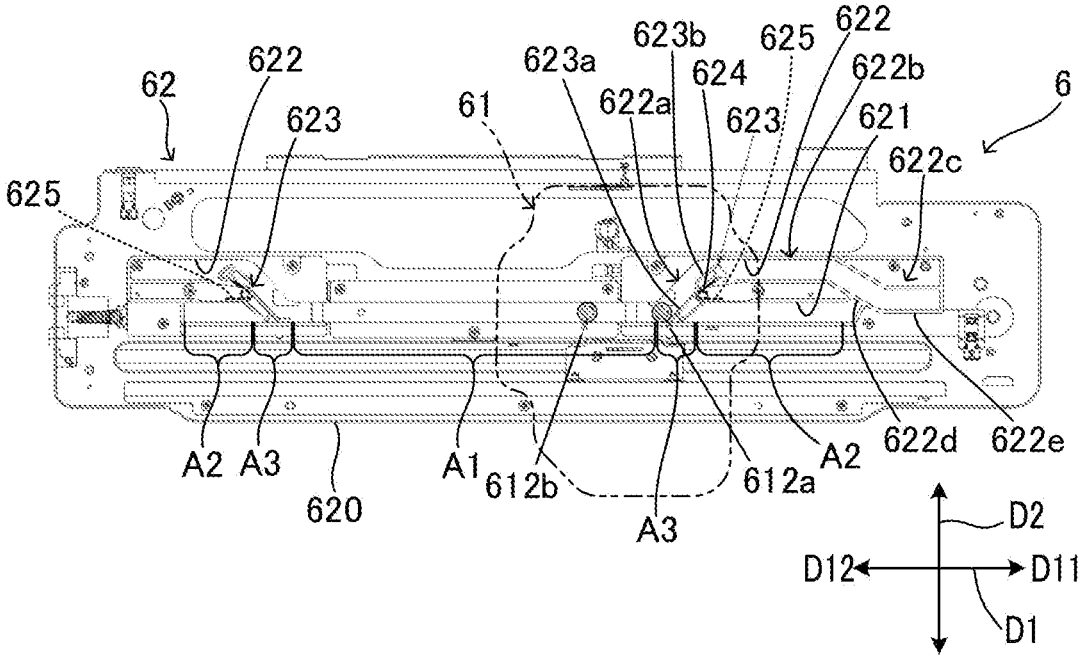
FIG. 7 shows a first state of two shaft portions and the shaft guide mechanism in the sheet binding device according to the embodiment.

In the present embodiment, the first groove 621 has two second areas A2 and two border area A3, one on each side of the first area A1 along the main direction D1 (see FIG. 7).

The specific direction described above is a direction in which the binding unit 61 moves from the first area A1, which is a starting point, to one of the second areas A2. It is noted that the direction in which the binding unit 61 moves from the first area A1 to the one of the second areas A2 is a direction in which the two shaft portions 612 move from the first area A1 to the one of the second areas A2. The main direction D1 is parallel to the specific direction.

In FIGS. 7 to 14, in a case where the binding unit 61 moves from the first area A1 to the second area A2 on the right side of the page, the first direction D11 is the specific direction, whereas in a case where the binding unit 61 moves from the first area A1 to the second area A2 on the left side of the page, the second direction D12 is the specific direction.

In the case where the first direction D11 is the specific direction, one of the two second grooves 622 shown on the right side in FIGS. 7 to 14 is used to guide one of the two shaft portions 612, whereas in the case where the second direction D12 is the specific direction, one of the two second grooves 622 shown on the left side in FIGS. 7 to 14 is used to guide one of the two shaft portions 612.

Similarly, in the case where the first direction D11 is the specific direction, one of the two movable guide members 623 shown on the right side in FIGS. 7 to 14 is used to guide the two shaft portions 612, whereas in the case where the second direction D12 is the specific direction, one of the two movable guide members 623 on the left side shown in FIGS. 7 to 14 is used to guide the two shaft portions 612.

The second grooves 622 each branch off from the first groove 621 at the corresponding border area A3 in the first direction D11 or the second direction D12. The distance between the first groove 621 and the second grooves 622 along the crossing direction D2 is smaller than the distance between the two shaft portions 612. The border areas A3 are branch parts of the first groove 621. The second grooves 622 are parallel to the first groove 621.

In the present embodiment, the guide base member 620 has the two second grooves 622 corresponding to the two second areas A2 of the first groove 621 (see FIGS. 7 to 11).

The movable guide members 623 are supported to be swingable between a first position and a second position around support shafts 624. The movable guide members 623 are disposed in the border areas A3 of the first groove 621. The movable guide members 623 are an example of a movable guide portion.

In the present embodiment, the shaft guide mechanism 62 includes the two movable guide members 623 corresponding to the two border areas A3 (see FIG. 7). The support shafts 624 are disposed between the first groove 621 and the second grooves 622.

Figure 9:
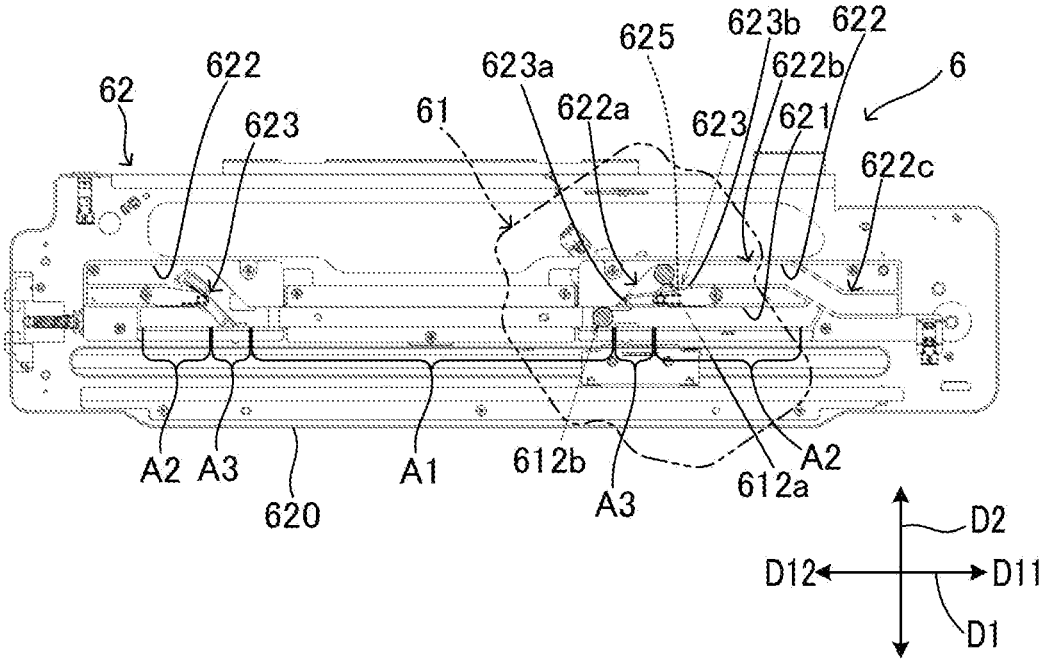
FIG. 9 shows a third state of the two shaft portions and the shaft guide mechanism in the sheet binding device according to the embodiment.
Figure 10:
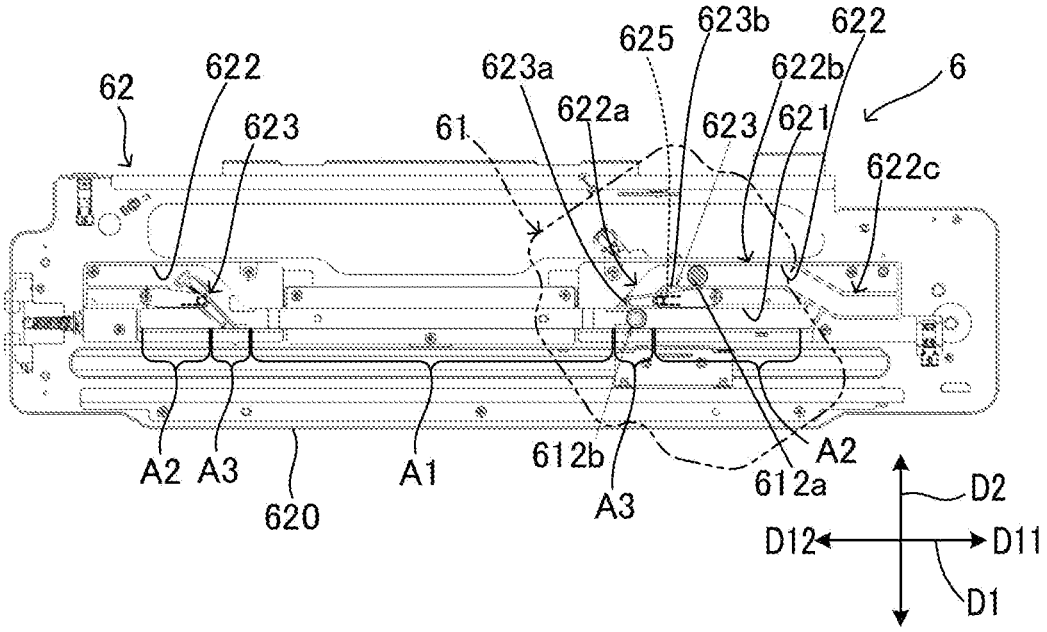
FIG. 10 shows a fourth state of the two shaft portions and the shaft guide mechanism in the sheet binding device according to the embodiment.

FIG. 7 shows a state where the two movable guide members 623 are in the first position. In addition, FIGS. 9 and 10 show a state where one of the two movable guide members 623 shown on the right side is in the second position.

The springs 625 bias the movable guide members 623 to cause the movable guide members 623 to be in the first position. For example, the springs 625 are torsion springs supported on the support shafts 624.

The movable guide members 623 each include a first arm portion 623*a* and a second arm portion 623*b* (see FIGS. 7 to 11).

When the movable guide members 623 are in the first position, the first arm portions 623*a* are disposed at respective first protruding positions (see FIG. 7). The first protruding positions extend from the respective support shafts 624 to the respective border areas A3 of the first groove 621.

When the movable guide members 623 are in the second position, the first arm portions 623*a* are disposed at respective first retracted positions (see FIGS. 9 and 10). The first retracted positions extend in the respective border areas A3 along an edge, adjacent to the respective second grooves 622, of the first groove 621. The first retracted positions are also the positions of the borders between the respective border areas A3 of the first groove 621 and the respective second grooves 622.

When the movable guide members 623 are in the first position, the second arm portions 623*b* are disposed at respective second protruding positions (see FIG. 7). The second protruding positions extend from the respective support shafts 624 to the respective second grooves 622.

When the movable guide members 623 are in the second position, the second arm portions 623*b* are disposed at respective second retracted positions (see FIGS. 9 and 10). The second retracted positions extend along edges of the respective second grooves 622.

[Operation of Sheet Binding Device 6 when Binding Unit 61 Moves in Specific Direction]

Operation of the sheet binding device 6 in a case where the first direction D11 is the specific direction will now be described with reference to FIGS. 7 to 14.

A first shaft portion 612*a* shown in FIGS. 7 to 14 is one of the two shaft portions 612 disposed downstream in the specific direction, whereas a second shaft portion 612*b* shown in FIGS. 7 to 14 is one of the two shaft portions 612 disposed upstream in the specific direction. That is, the second shaft portion 612*b* is disposed to be spaced apart from the first shaft portion 612*a* upstream in the specific direction.

Figure 8:
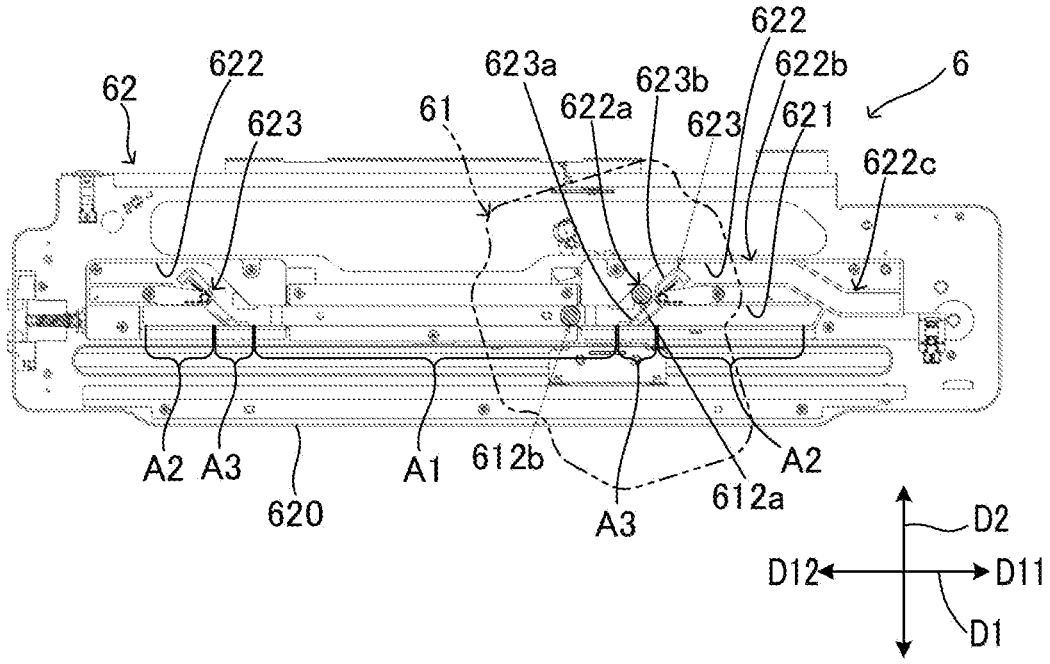
FIG. 8 shows a second state of the two shaft portions and the shaft guide mechanism in the sheet binding device according to the embodiment.

When the binding unit 61 moves from the first area A1 in the specific direction, the first arm portion 623*a* at the first protruding position guides the first shaft portion 612*a* from the border area A3 to the second groove 622 (see FIGS. 7 and 8).

The first shaft portion 612*a* is guided by the first arm portion 623*a* to enter the second groove 622 from the border area A3 of the first groove 621 (see FIG. 8). At this moment, the second shaft portion 612*b* is disposed in the first area A1 of the first groove 621. The first shaft portion 612*a* engages with the second groove 622 while being fitted in the second groove 622.

When the binding unit 61 further moves in the specific direction, the first shaft portion 612*a* guided by the second groove 622 abuts on the second arm portion 623*b*. When brought into contact with the first shaft portion 612*a*, the second arm portion 623*b* is pushed away from the second protruding position to the second retracted position (see FIG. 9).

As the second arm portion 623*b* is pushed away from the second protruding position to the second retracted position by the first shaft portion 612*a*, the movable guide member 623 swings from the first position to the second position.

As the movable guide member 623 swings from the first position to the second position, the first arm portion 623*a* moves from the first protruding position to the first retracted position (see FIG. 9). When the first arm portion 623*a* is located at the first retracted position, a path in the first groove 621 from the border area A3 to the second area A2 opens.

As the binding unit 61 moves in the specific direction while the second arm portion 623*b* is pushed away to the second retracted position by the first shaft portion 612*a*, the second shaft portion 612*b* reaches the border area A3 of the first groove 621.

When the binding unit 61 further moves in the specific direction and the first shaft portion 612*a* separates from the second arm portion 623*b* in the specific direction, the second shaft portion 612*b* is brought into a state shown in FIG. 10.

In the state shown in FIG. 10, the second shaft portion 612*b* moves from the border area A3 to the second area A2 while, in the border area A3, preventing the first arm portion 623*a* from swinging from the first retracted position to the first protruding position.

Figure 3:
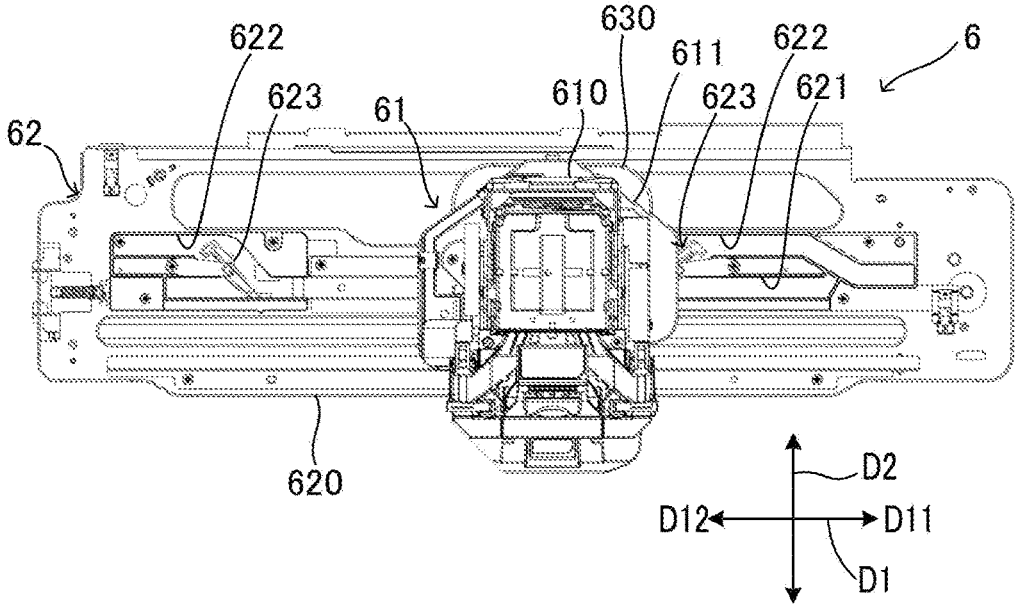
FIG. 3 is a plan view of the sheet binding device according to the embodiment, showing an example of the sheet binding device when a stapler is in a first processing state.
Figure 4:
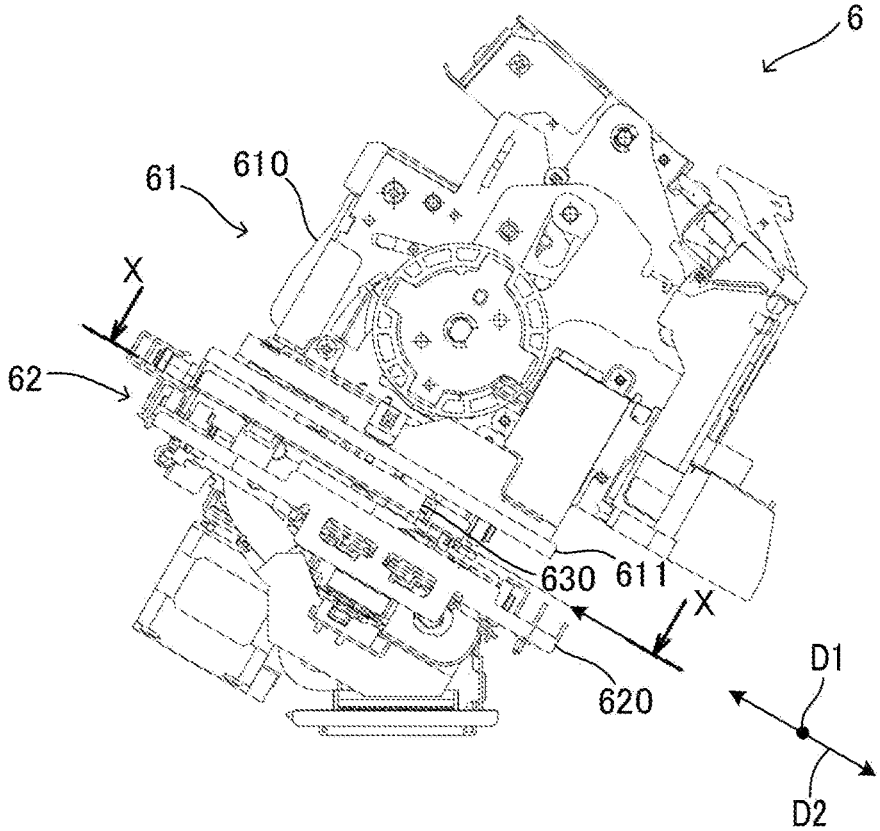
FIG. 4 is a side view of the sheet binding device according to the embodiment.
Figure 5:
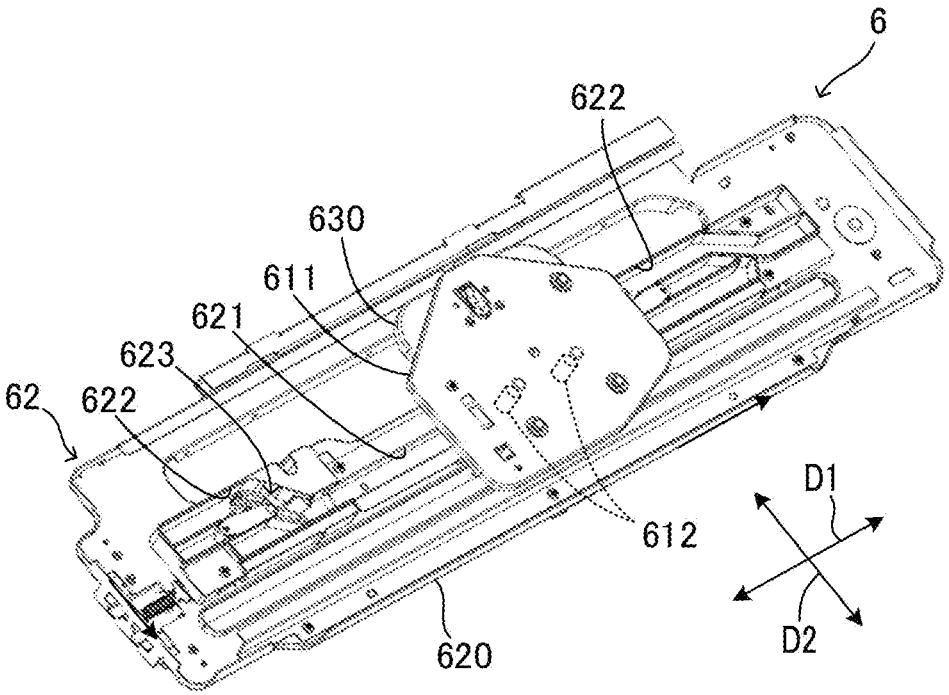
FIG. 5 is a perspective view of a unit base member and a shaft guide mechanism in the sheet binding device according to the embodiment.

FIGS. 3 and 7 show the sheet binding device 6 when the two shaft portions 612 are disposed in the first groove 621 inside a range from the first area A1 to the border area A3.

When the two shaft portions 612 are disposed in the first groove 621 inside the range from the first area A1 to the border area A3, the stapler 610 is in a first orientation to perform the binding process on the stacks of the sheets 9 (see FIG. 3). The first orientation is parallel to the main direction D1.

In a case where the binding process is performed on the middle area, along the width direction, of the stacks of the sheets 9, the first shaft portion 612*a* is disposed at a first target position as the transfer device 63 moves the binding unit 61. The first target position may be any position in the first groove 621 inside the range from the first area A1 to the border area A3. For example, the first target position may be selected from a plurality of predetermined candidates.

FIG. 3 shows an example of the sheet binding device 6 when the stapler 610 is in a first processing state. In the first processing state, the stapler 610 is in the first orientation to perform the binding process on the stacks of the sheets 9 at a position corresponding to the first target position.

Figure 11:
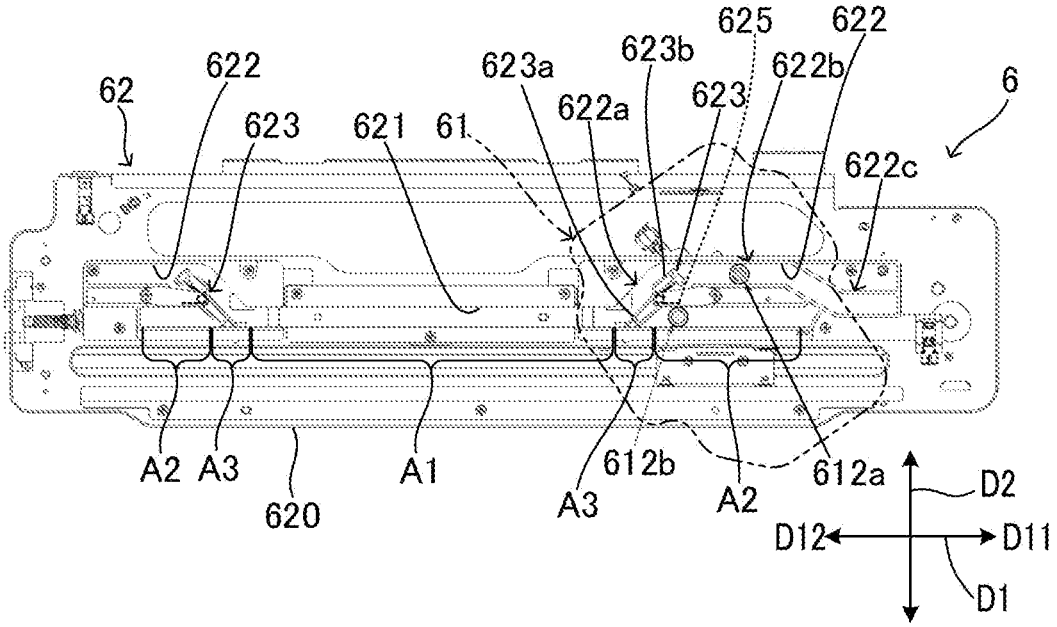
FIG. 11 shows a fifth state of the two shaft portions and the shaft guide mechanism in the sheet binding device according to the embodiment.
Figure 12:
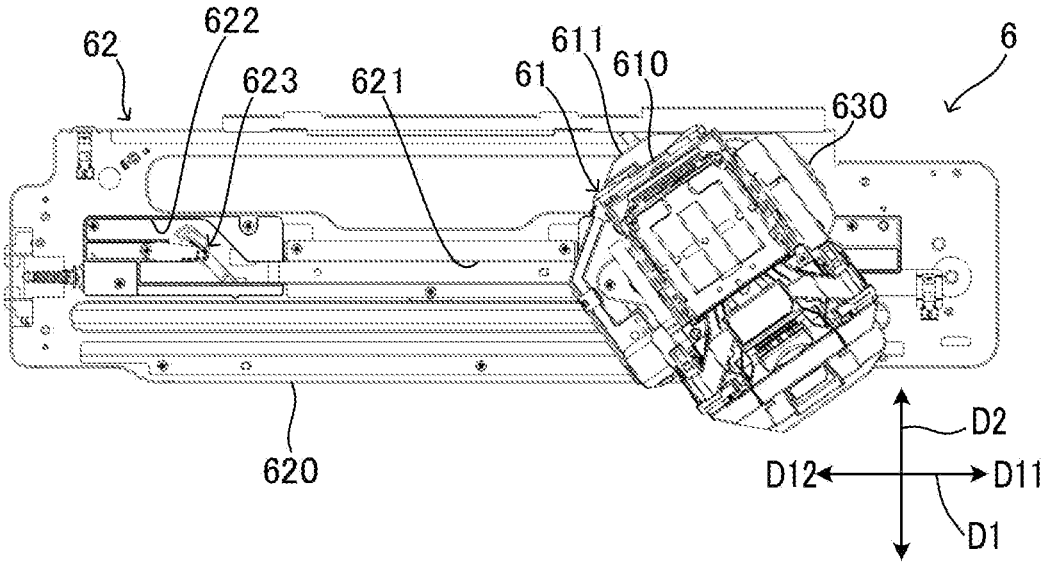
FIG. 12 is a plan view of the sheet binding device according to the embodiment, showing an example of the sheet binding device when the stapler is in a second processing state.

FIGS. 10 to 12 show the sheet binding device 6 when the first shaft portion 612*a* is disposed in the second groove 622 and the second shaft portion 612*b* is disposed in the first groove 621.

When the first shaft portion 612*a* is disposed in the second groove 622 and the second shaft portion 612*b* is disposed in the first groove 621, the stapler 610 is in a second orientation to perform the binding process on the stacks of the sheets 9. The second orientation is inclined with respect to the first orientation. That is, the second orientation is inclined with respect to the main direction D1.

More specifically, the second groove 622 includes a communication portion 622*a* and a parallel portion 622*b* (see FIG. 7).

The communication portion 622*a* adjoins the border area A3 of the first groove 621. The communication portion 622*a* extends from the border area A3 in the specific direction and is inclined with respect to the main direction D1 (see FIG. 7). In other words, the communication portion 622*a* is inclined from the border area A3 to be away from the second area A2 of the first groove 621 in the specific direction. The communication portion 622*a* is an example of a first inclined portion.

The parallel portion 622*b* adjoins an end of the communication portion 622*a* facing the specific direction. The parallel portion 622*b* is parallel to the second area A2 of the first groove 621 (see FIG. 7). In other words, the parallel portion 622*b* extends parallel with the second area A2 from the communication portion 622*a* in the specific direction.

When the first shaft portion 612*a* is disposed in the parallel portion 622*b* of the second groove 622 and the second shaft portion 612*b* is disposed in the first groove 621, the stapler 610 is in the second orientation to perform the binding process on the stacks of the sheets 9 (see FIGS. 10 to 12).

In a case where the binding process is performed on the corner part of the stacks of the sheets 9, the first shaft portion 612*a* is disposed at a second target position as the transfer device 63 moves the binding unit 61. The second target position may be any position inside the parallel portion 622*b* of the second groove 622.

The second target position corresponds to the corner part of the stacks of the sheets 9. The second target position is set according to the size of the sheets 9.

FIG. 12 shows an example of the sheet binding device 6 when the stapler 610 is in a second processing state. In the second processing state, the stapler 610 is in the second orientation to perform the binding process on the stacks of the sheets 9 at a position corresponding to the second target position.

As described above, when the unit support member 630 moves in the specific direction, the movable guide member 623 can swing from the first position to the second position. When in the first position, the movable guide member 623 guides the first shaft portion 612*a* from the border area A3 of the first groove 621 to the second groove 622.

The movement of the first shaft portion 612*a* to the second groove 622 through the border area A3 causes the stapler 610 to swing around the second shaft portion 612*b* together with the unit base member 611. At this moment, the stapler 610 normally rotates about the second shaft portion 612*b*.

In addition, when the first shaft portion 612*a* moves to the second groove 622 through the border area A3, the movable guide member 623 swings from the first position to the second position by being brought into contact with the first shaft portion 612*a*.

After the first shaft portion 612*a* moves to the second groove 622, the second shaft portion 612*b* reaches the border area A3. When the second shaft portion 612*b* reaches the border area A3, the movable guide member 623 in the second position guides the second shaft portion 612*b* to the second area A2 along the first groove 621.

[Operation of Sheet Binding Device 6 when Binding Unit 61 Moves in Return Direction]

Next, operation of the sheet binding device 6 when the binding unit 61 moves in a direction opposite the specific direction from the state where the first shaft portion 612*a* is disposed in the parallel portion 622*b* of the second groove 622 will be described.

In the description below, the direction opposite the specific direction in which the first shaft portion 612*a* disposed in the parallel portion 622*b* of the second groove 622 starts moving is referred to as "return direction". When the binding unit 61 moves in the return direction, the sheet binding device 6 operates in the reverse order of the way when the binding unit 61 moves in the specific direction.

That is, when the binding unit 61 moves in the return direction from the state where the first shaft portion 612*a* is disposed in the parallel portion 622*b* of the second groove 622, the second shaft portion 612*b* pushes the first arm portion 623*a* away from the first protruding position to the first retracted position (see FIG. 10).

As the first arm portion 623*a* is pushed away from the first protruding position to the first retracted position, the movable guide member 623 swings from the first position to the second position.

Furthermore, the second shaft portion 612*b* moves from the border area A3 to the first area A1 while, in the border area A3, preventing the first arm portion 623*a* from swinging from the first retracted position to the first protruding position (see FIG. 10).

As the binding unit 61 moves in the return direction while the second shaft portion 612*b* prevents the first arm portion 623*a* from moving, the first shaft portion 612*a* reaches a position where the second arm portion 623*b* disposed at the second retracted position is prevented from swinging.

Furthermore, as the binding unit 61 moves in the return direction while the first shaft portion 612*a* prevents the second arm portion 623*b* disposed at the second retracted position from swinging, the second shaft portion 612*b* separates from the first arm portion 623*a* (see FIG. 9).

After the binding unit 61 further moves in the return direction and the second shaft portion 612*b* separates from the first arm portion 623*a*, the first shaft portion 612*a* separates from the second arm portion 623*b*, and the movable guide member 623 swings from the second position to the first position (see FIG. 8).

After the binding unit 61 further moves in the return direction and the first shaft portion 612*a* separates from the second arm portion 623*b*, the first shaft portion 612*a* moves from the second groove 622 to the first groove 621 (see FIG. 7).

As described above, the movement of the binding unit 61 in the return direction alone causes the two shaft portions 612 to return to the first groove 621 and causes the stapler 610 to return from the second orientation to the first orientation (see FIG. 3).

When the binding process is required to be performed on the middle area, along the width direction, of the stacks of the sheets 9, the control device 8 performs a first binding control on the sheet binding device 6. In the first binding control, the control device 8 causes the transfer device 63 to execute a process of moving the first shaft portion 612*a* to the first target position. The control device 8 then causes the stapler 610 to execute the binding process.

When the binding process is required to be performed on the corner parts of the stacks of the sheets 9, the control device 8 performs a second binding control on the sheet binding device 6. In the second binding control, the control device 8 causes the transfer device 63 to execute a process of moving the first shaft portion 612*a* to the second target position. The control device 8 then causes the stapler 610 to execute the binding process.

The sheet binding device 6 also operates in the same manner as above in a case where the second direction D12 is the specific direction.

The sheet binding device 6 does not require a driving source dedicated to rotating the stapler 610. In addition, to change the orientation of the stapler 610, the binding unit 61 only needs to travel the shortest distance to the target position. Accordingly, the time to prepare for the binding process is short.

The sheet binding device 6 can change the orientation of the stapler 610 in a short time with its simplified configuration.

[Supplemental Portion 622*c* of Second Groove 622]

In the description below, one of the two second grooves 622 shown on the right side in FIGS. 7 to 11 and 13 will be described.

The second groove 622 further includes a supplemental portion 622*c* adjoining an end of the parallel portion 622*b* facing the specific direction (see FIGS. 7 to 11 and 13). The supplemental portion 622*c* extends from the parallel portion 622*b* toward the second area A2 of the first groove 621.

The supplemental portion 622*c* includes an inclined portion 622*d* and an extended portion 622*e*. The inclined portion 622*d* is an example of a second inclined portion.

The inclined portion 622*d* is inclined from the parallel portion 622*b* toward the first groove 621 in the specific direction. The extended portion 622*e* extends from the inclined portion 622*d* in the specific direction. The extended portion 622*e* is parallel to the first groove 621.

Figure 13:
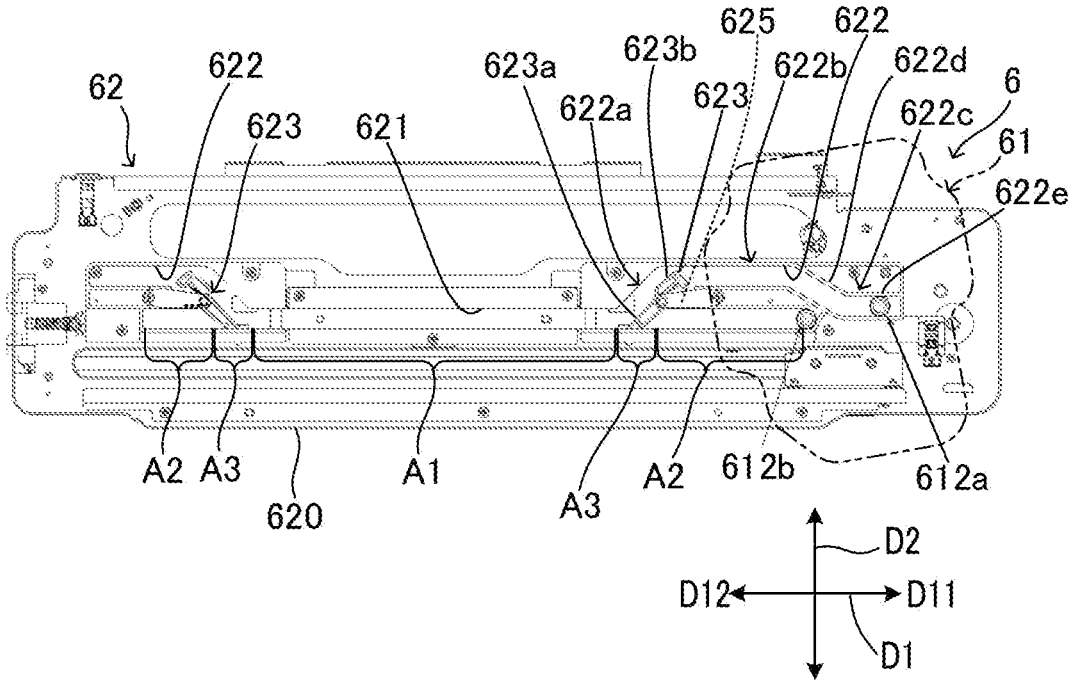
FIG. 13 shows a sixth state of the two shaft portions and the shaft guide mechanism in the sheet binding device according to the embodiment.
Figure 14:
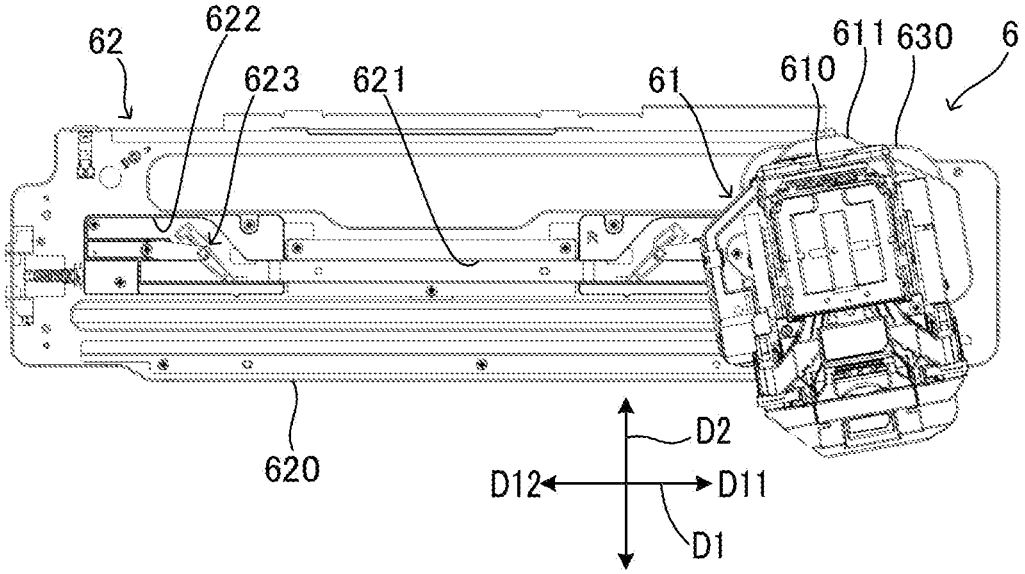
FIG. 14 is a plan view of the sheet binding device according to the embodiment, showing the sheet binding device when a binding unit is in a retracted state.

The binding unit 61 can move in the specific direction until the first shaft portion 612*a* reaches the supplemental portion 622*c* of the second groove 622 (see FIG. 13).

In the description below, the travel range of the binding unit 61 in the main direction D1 for the binding process is referred to as "normal travel range". The position of the binding unit 61 when the first shaft portion 612*a* is located at the supplemental portion 622*c* of the second groove 622 is a retracted position outside the normal travel range.

The binding unit 61 needs to be at the retracted position in some specific cases. For example, the specific cases include removal of the sheets 9 jammed near the inclined tray 60 and maintenance of the sheet binding device 6.

For example, the binding unit 61 may be moved to the retracted position while the stapler 610 is in the second orientation shown in FIG. 12.

However, as shown in FIG. 3, the longitudinal direction of the stapler 610 is the crossing direction D2 intersecting the main direction D1. In this case, if the binding unit 61 is moved to the retracted position while the stapler 610 is in the second orientation, the binding unit 61 needs a large retraction space in the main direction D1.

In addition, a sheet guide for guiding the sheets 9 on the conveyance path 300 may be disposed adjacent to the sheet binding device 6. Furthermore, the sheet guide may be included in an openable-and-closable cover member.

In the above-described case, the stapler 610 needs to be held in an orientation in which the stapler 610 does not abut on the sheet guide when the binding unit 61 is moved to the retracted position.

In the sheet binding device 6, the binding unit 61 can move in the specific direction until the first shaft portion 612*a* reaches the supplemental portion 622*c* of the second groove 622 (see FIG. 13). The orientation of the stapler 610 when the first shaft portion 612*a* reaches the supplemental portion 622*c* of the second groove 622 is closer to the first orientation than to the second orientation (see FIG. 14).

That is, when the binding unit 61 moves in the specific direction, the communication portion 622*a* and the parallel portion 622*b* cause the stapler 610 to normally rotate about the second shaft portion 612*b* and guide the binding unit 61 to the position for the corner binding process.

In addition, when the binding unit 61 further moves in the specific direction from the position for the corner binding process, the supplemental portion 622*c* causes the stapler 610 to reversely rotate about the second shaft portion 612*b* and guides the binding unit 61 to the retracted position. The retracted position is a position away from the position for the corner binding process in the specific direction.

The effect of the supplemental portion 622*c* can reduce the retraction space for the binding unit 61 when the binding unit 61 is moved outside the normal travel range.

Furthermore, when the binding unit 61 is located outside the normal travel range, the stapler 610 can be held in the orientation in which the stapler 610 does not abut on the sheet guide of the cover member.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet binding device comprising:

a sheet tray on which sheets are stacked;

a base portion extending in a width direction along a specific side of the sheets;

a binding unit capable of reciprocating on the base portion in the width direction and capable of performing an edge binding process for binding a part of the specific side of the sheets or a corner binding process for binding a corner part of the sheets; and a guide portion formed in the base portion and configured to guide movement of the binding unit, wherein the binding unit includes:

a stapler configured to bind the sheets;

a first movable body movable on the base portion in the width direction; and a second movable body to which the stapler is secured and which is swingably supported with the stapler on an upper surface of the first movable body, the second movable body includes a first shaft portion and a second shaft portion each passing through the first movable body, the second shaft portion is disposed to be spaced apart from the first shaft portion upstream in a specific direction extending from a middle area to one end area of the base portion in the width direction, the guide portion includes:

a first groove extending in the base portion from the middle area to the one end area in the width direction, including a branch part between the middle area and the one end area, and configured to guide the first shaft portion and the second shaft portion;

a second groove branching off from the branch part, being parallel to the first groove, and configured to guide the first shaft portion; and a movable guide portion disposed at the branch part and swingable between a first position and a second position, the second groove includes:

a first inclined portion inclined from the branch part to be away from the first groove in the specific direction;

a parallel portion extending parallel with the first groove from the first inclined portion in the specific direction;

a second inclined portion inclined from the parallel portion toward the first groove in the specific direction; and an extended portion extending parallel with the first groove from the second inclined portion in the specific direction, the first shaft portion and the second shaft portion engage with the first groove or the second groove, when the first movable body moves from the middle area to the one end area, the movable guide portion is disposed in the first position to guide the first shaft portion from the branch part to the second groove, when the first shaft portion moves to the second groove through the branch part, the movable guide portion swings from the first position to the second position by being brought into contact with the first shaft portion, when the second shaft portion reaches the branch part after the first shaft portion moves to the second groove, the movable guide portion in the second position guides the second shaft portion along the first groove, when the binding unit moves in the specific direction, the first inclined portion and the parallel portion cause the stapler to normally rotate about the second shaft portion from a first orientation to a second orientation and guide the binding unit to a position for the corner binding process, when the first shaft portion is disposed in the parallel portion of the second groove and the second shaft portion is disposed in the first groove, the stapler performs the corner binding process in the second orientation, and when the binding unit further moves in the specific direction from the position for the corner binding process, the second inclined portion and the extended portion cause the stapler to reversely rotate about the second shaft portion from the second orientation to an orientation between the second orientation and the first orientation and further guide the binding unit together with the stapler in the second orientation to a retracted position on a downstream side of a position for the corner binding process in the specific direction.

2. An image forming apparatus comprising:

a printing device configured to form images on sheets; and the sheet binding device according to the claim 1 configured to perform the edge binding process or the corner binding process on a stack of the sheets on which the images are formed by the printing device.

* * * * *